United States Patent [19]

Schild et al.

[11] Patent Number: 4,523,425

[45] Date of Patent: Jun. 18, 1985

[54] REINFORCEMENT CABLE FOR ELASTOMERIC CONDUITS

[75] Inventors: Franz Schild, Heinsberg; Wolfgang Weidenhaupt, Erkelenz, both of Fed. Rep. of Germany

[73] Assignee: Akzo NV, Arnhem, Netherlands

[21] Appl. No.: 488,774

[22] Filed: Apr. 26, 1983

[30] Foreign Application Priority Data

Apr. 26, 1982 [DE] Fed. Rep. of Germany ..... 3215506

[51] Int. Cl.[3] ..... D07B 1/06; D07B 1/14

[52] U.S. Cl. ..... 57/212; 57/210; 57/211; 57/902

[58] Field of Search ..... 57/206, 207, 210, 211, 57/212, 214, 902; 152/356, 359

[56] References Cited

U.S. PATENT DOCUMENTS

| | | | |
|---|---|---|---|
| 2,112,525 | 3/1938 | Foster | 57/902 X |
| 2,598,033 | 5/1952 | Bourbon | 57/212 |
| 3,273,978 | 9/1966 | Paul | 57/212 X |
| 3,552,468 | 9/1971 | Gallagher | 152/359 |
| 3,805,508 | 4/1974 | Maderna | 57/212 |
| 4,022,009 | 5/1977 | Assendelft | 57/902 X |
| 4,030,248 | 6/1977 | Assendelft | 57/902 X |
| 4,430,851 | 2/1984 | Sundet | 57/211 |

*Primary Examiner*—Donald Watkins
*Attorney, Agent, or Firm*—Michael J. Striker

[57] ABSTRACT

Reinforcement cable of metal wire for elastomeric conduits are disclosed, containing at least two corded-together strands which each have two or more wires and at least one outerlying of which strands is composed from two or more core wires wrapped by at least one spiral-shaped strand winding wire. Particular embodiments include wrapping with strands; use of three to seven thereof; enveloping the strands with preferably up to four cable winding wires; arranging various of the combination sets of core wires, strands and cables to be of equal pitch, pitch angle and rotary direction, mainly in-phase; and staggering the cores wires to define a reciprocal contact curve parallel thereto.

15 Claims, 9 Drawing Figures

REINFORCEMENT CABLE FOR ELASTOMERIC CONDUITS

BACKGROUND OF THE INVENTION

The invention concerns a reinforcement cable of metal wires for elastomeric conduits.

Customarily, reinforcement cable has been embedded into the elastomeric conduits in layers, thus for example with the production of vehicle pneumatic tires, driving belts or conveyor belts. Herewith metal wires are disposed in simple cable lay with a single wire diameter from as a rule 0.12 up to 0.5 mm mainly in one or two layers. For increasing the loading capacity of such elastomeric conduits either several layers of metal wire cables in simple cable lay or one or two layers of cables in compound, i.e. more manifold or intricate cable lay has been necessary. This higher loading capacity is, for example, prompted with the insertion of the reinforcement cable into Lkw-pneumatic tires and pneumatic surfaces of earthmoving machines. Metal wires in simple cable lay, of which several become cabled into a double or multiple cable, are named strands.

The here employed terms of art in the field of cable construction are taken from the book *Stabldrahterzeugnisse,* Verlag Stahleisen, 1956, Volume I.

Since the production of elastomeric conduits with several layers of simple cable lay metal wire cables is very work intensive, reinforcement cable in compound cable lay, thus reinforcement cable which is composed from at least two cabled together layers each of two or more wires, are preferably used with higher loading.

It has however been shown that such reinforcement cable undesirably corrodes into the elastomeric/conduit with a surface injury up to the cable layer of this composite material. The life span of the composite material is as a result of this indeed impaired by minute injuries. Through the very narrow circumstances of the individual wires upon embedding into the elastomer, they cannot sufficiently reach into the core region of the cable. The wire Section is accordingly accessible for corrosive media. If the individual wires are laid parallel next to each other, spreading of corrosive media into the composite material is even encouraged by the capillaries formed by the wires.

Surprisingly, it has now been determined that the corrosion tendency of a reinforcement cable composed of several strands in elastomeric conduits is then not greater than that of the simple cable lay metal wire cable, if at least the outer lying layers are wrapped with coil-shaped winding wire.

SUMMARY OF THE INVENTION

It is therefore an object of the present invention to make available a reinforcement conduit for elastomeric conduits which is composed from at least two cabled-together layers of, in each case, two or more wires, which after its embedding into the elastomeric material displays approximately the same or the same behavior against corrosion as the cable in simple cable lay.

According to the present invention, the object is attained by a reinforcement cable of the above set forth type which is thereby distinguished in that at least one outerlying strand is composed from two or more core wires wrapped by at least one coil-shaped strand winding wire.

The metal wires should come into a good connection with the elastomeric material.

They can, though, also be coated with a second metal, plastic or an other material, whereby between metal wire and coating material on the one hand and coating material and elastomeric material on the other hand, good connecting tendency should be provided. Particularly well suitable are wires from steel, typically from carbon steel, but also from other types of steel, for example from alloyed or highly alloyed steels with lower Fe-content. Steel wires coated with brass are preferably used.

By outerlying strands is to be understood the strands which lay visibly at the outer side of the prepared reinforcement cable.

There can be built-in to the reinforcement cable aside from the strands also one or more individual wires.

It is of advantage if the strands collectively are wrapped by at least one coil-shaped cable winding wire and/or at least one cable winding strand. As a rule, the reinforcement cable according to the present invention is composed of three to seven strands, from up to four cable winding wires and/or from up to four cable winding strands.

By strands according to the present invention is to be understood strands in the reinforcing cable which as a rule are present in greater number than the cable winding strands. There can however also be provided equally many strands and cable winding strands, whereby for purposes of distinction the one group is named strands and the other cable winding strands.

As a rule, the strands and/or the cable winding strands contain two to eight core wires; however, also more core wires is possible.

Similarly, the strands and/or the cable winding strands contain as a rule up to four strand winding wires, whereby even in this case a greater number is possible.

By core wires are to be understood such wires as are in strands or cable winding strands and are as a rule in the majority.

As strand winding wires is to be understood those wires in the strands or cable winding which are as a rule present in lesser number.

The strands, respectively the cable winding strands, can for example contain wires to the extent of 3+1, 5+2, 6+3, 7+2, or generally $n_1+n_2$, wherein the first number, i.e. $n_1$, specifies the number of core wires and the second number, i.e. $n_2$, the number of strand winding wires.

There can, however, also be contained in the strands, respectively the cable winding strands, the same number of core wires and also strand winding wires. Such strands, respectively cable winding strands, thus then contain 2+2, 3+3, 4+4, i.e. $n_1+n_2$, in which $n_1=n_2$ is to be understood to be the wires with which the first number, respectively $n_1$, and the second number, respectively $n_2$, represent the core wires and the strand winding wires.

It has proven to be advantageous for the core wires and strand winding wires to be of twisted or screw-shaped form of the same slope, the same helix angle, and the same direction of revolution, disposed bundled and with the core wires of a strand nearly in phase. The preferred length of twist amounts in this case to from 10 up to 20 mm.

It is particularly favorable for the core wires of the strands and/or of the cable winding strands to be so next to one another and counter one another disposed that each of the core wires is in linear contact with at least one other core wire, the contact line running parallel to the direction of the core wires.

These strands are known from DE-OS No. 26 19 086 and as reinforcement cable in simple cable lay. The reinforcement cables have proven to be particularly favorable for use as reinforcement cable in elastomeric conduits on account of the fact that the winding wire additionally has carrying function and further that the elastomeric material upon embedding of the cable penetrates particularly well even into the core region of the cable and thereby extensively avoids a corrosion of the wires also with stronger injuries.

Surprisingly, it has turned out that with a repeated cable lay, this cable as strands produces a reinforcement cable for elastomeric conduits which approximates the favorable, above-mentioned characteristics of the individual cables.

It is particularly advantageous if the strands and the cable winding wires and/or cable winding strands of screw-shaped form are of equal pitch, equal pitch angle and the same direction of rotation, and the strands are disposed connected nearly in-phase.

Therewith it is favorable for the strand winding wires to be disposed out-of-phase from the core wires, preferably by about a half cycle. The preferred length of twist for the second cable lay lies from about 10 to 30 mm.

With this embodiment are employed processes known from DE-OS No. 26 19 086 for the production of the cable with the second cable lay, whereby instead of core wires strands and instead of winding wires cable winding wires and/or cable winding strands are employed.

It was surprising that with such reinforcement cable despite its as a rule considerably greater number of wires and therewith its greater cross-section the same good, above-described characteristics of the in DE-OS No. 26 19 086 described cable could be attained.

The reinforcement cable according to the present invention is preferably to be used for the production of vehicle pneumatic tires, particularly of pneumatic tires for trucks or earth moving machines.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
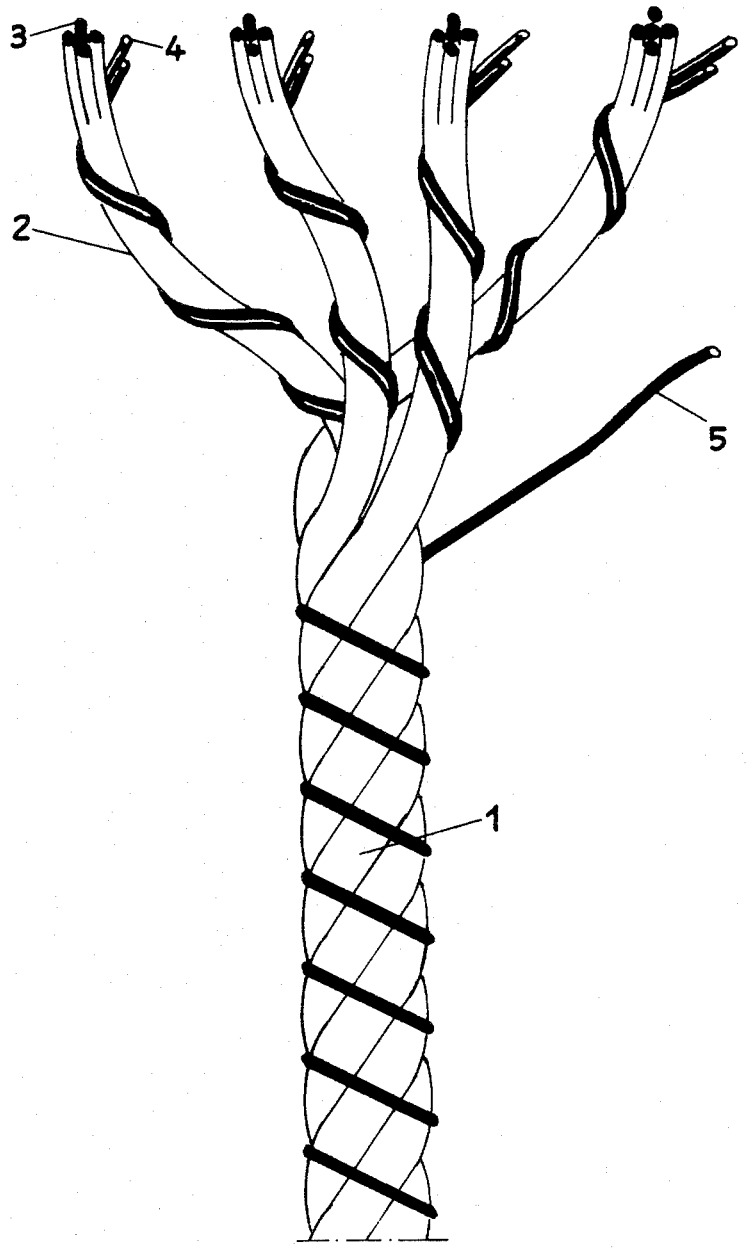
FIG. 1 is a diagrammatic representation of the principlary construction of a reinforcement cable according to the present invention with four strands and a cable winding wire of the construction $4\times(5+2)+1$.

FIG. 1 represents the principal construction of a reinforcement cable according to the present invention with four strands 2, which are composed from five core wires 3 each and two strands winding wires 4 each and one cable winding wire 5.

Generally, a construction $4\times(5+2)+1$ is provided. The strands 2 are herewith twisted in cross-lay. The strands 2 could preferably be fashioned so that the core wires 3 and the strand winding wires 4 are of coil-like shape, having equal pitch, pitch angle and the same rotary direction, the core wires 3 of a strand 2 being disposed connected nearly in-phase. The core wires 3 and strand winding wires 4 are only represented in the upper half of FIG. 1. For better functional clarity in the connected cable only the strands 2 are represented as thick cable without strand winding wire 4.

Figure 2:
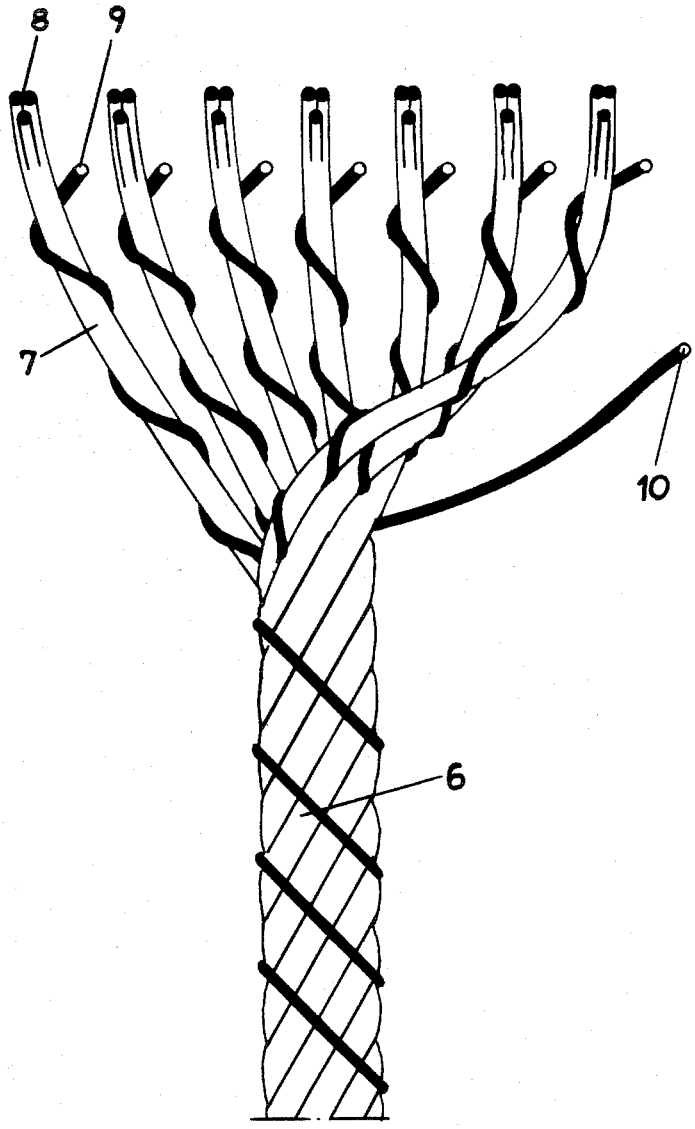
FIG. 2 is a diagrammatic representation of the principlary construction of a reinforcements cable according to the present invention with seven strands and a cable winding wire of the construction $7\times(3+1)+1$.

FIG. 2 represents the principal construction of a reinforcement cable 6 according to the present invention with seven strands 7, which are composed from three core wires 8 each and a strand winding wire 9 each, and a cable winding wire 10. Generally, the construction is given as $7\times(3+1)+1$. Here, too, the strands are distributed in a cross-lay. In other respects the form of representation corresponds to that of FIG. 1.

Figure 3:
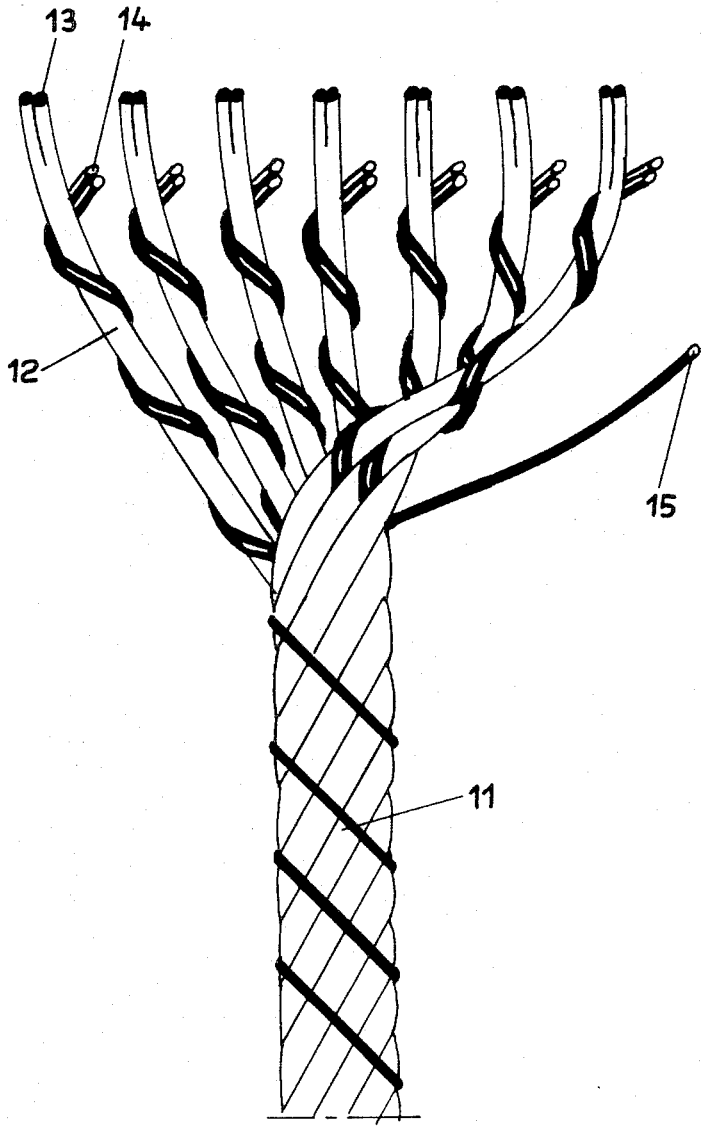
FIG. 3 is a diagrammatic representation of a reinforcement cable according to the present invention with seven strands and a cable winding wire of the construction $7\times(2+2)+1$.

FIG. 3 represents the principal construction of a reinforcement cable 11 according to the present invention having seven strands 12, which are each composed from two core wires 13 and two strand winding wires 14, and a cable winding wire 15. Generally, the construction is given as $7\times(2+2)+1$. The statements made with regard to FIG. 1 likewise are valid for FIG. 3.

Figure 4:
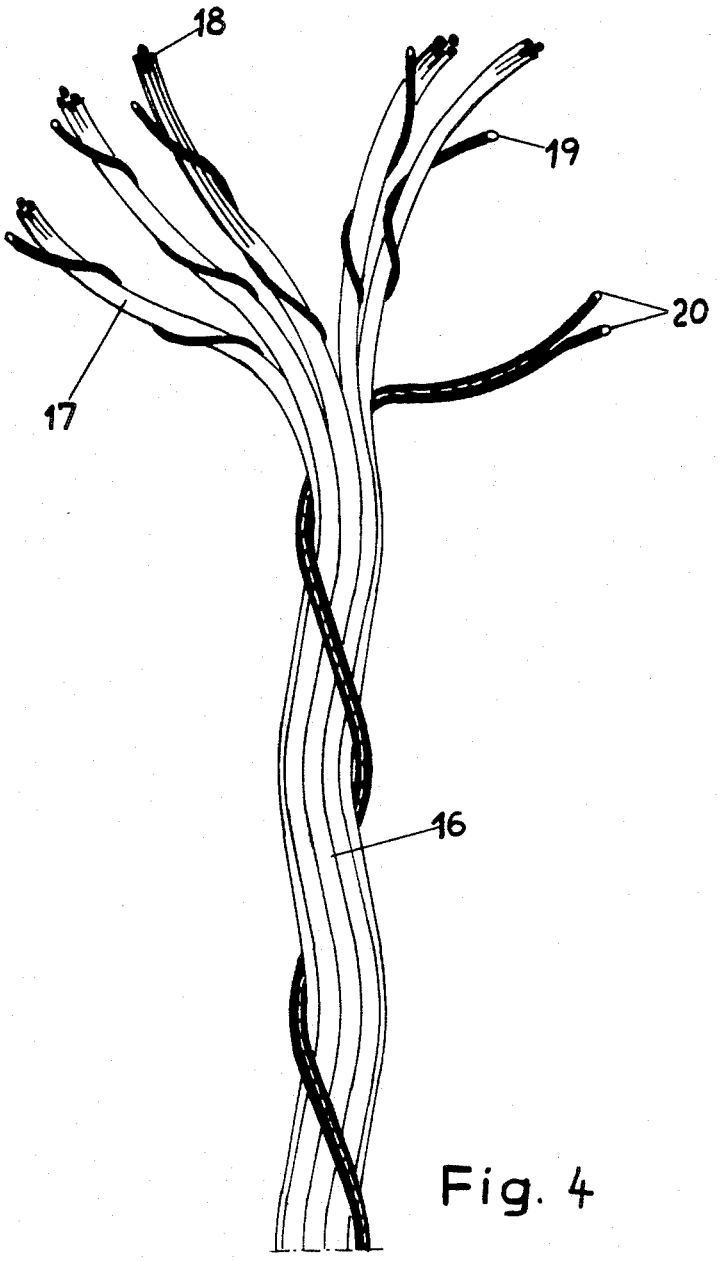
FIG. 4 is a diagrammatic representation of a reinforcement cable according to the present invention having five strands and two cable winding wires of the construction $5\times(4+1)+2$.

FIG. 4 shows the principal construction of a reinforcement cable 16 according to the present invention having five strands 17 and two cable winding wires 20 of screw-like form which are with the same slope, the same slope angle and the same direction of rotation, and which strands 17 are disposed connected nearly in-phase, whereby the cable winding wires 20 are arranged roughly one half pitch length phase-displaced with respect to strands 17. The strands 17 composed each from four core wires 18, whereby each strand 17 is developed enveloped with a helically shaped strand winding wire 19. Preferably, strands of this type find use having the core wire 18 and the strand winding wires 19, likewise of screw-like shape and being with the same slope, the same slope angle and same rotary direction, also with core wires 18 of a strand 17 disposed connected nearly in-phase.

Figure 5:
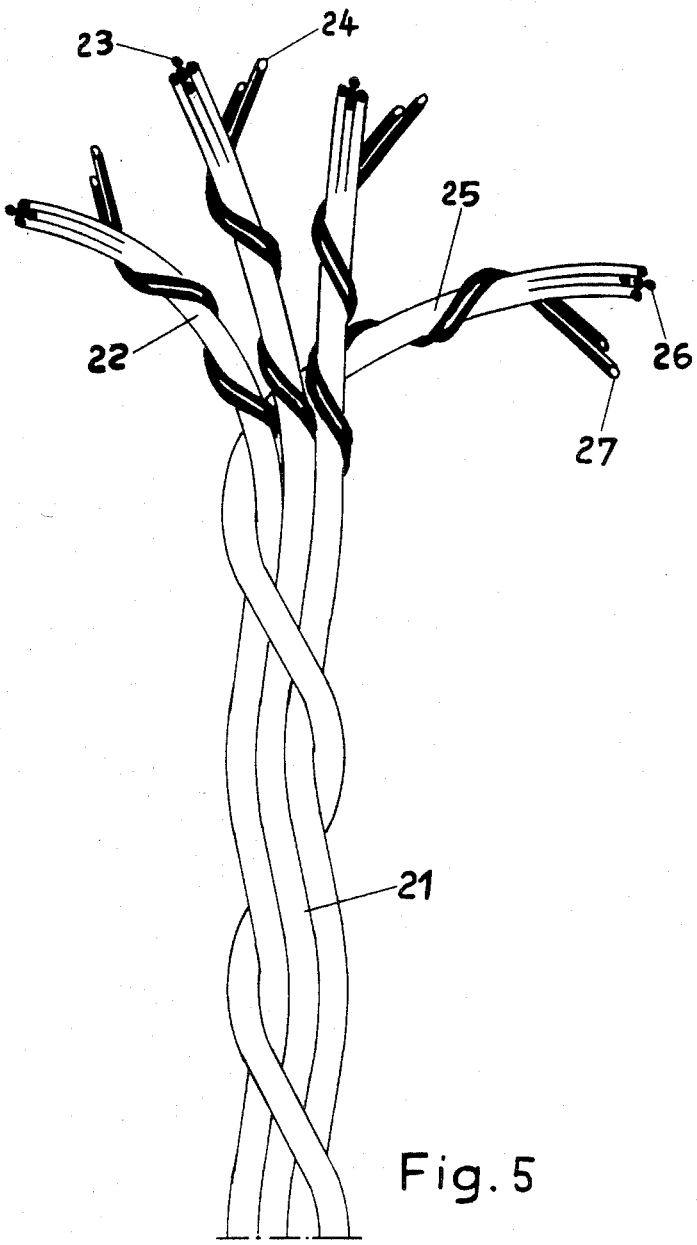
FIG. 5 is a diagrammatic representation of a reinforcement cable according to the present invention with three strands and a winding strand of the construction $(3+1)\times(5+2)$.

FIG. 5 shows the principal construction of a reinforcement cable 21 according to the present invention provided with three strands 22 and cable winding strand 25 of screw-like shape with similar pitch, pitch angle and rotary direction, the strands 22 being disposed connected nearly in-phase so that the cable winding strands 25 is arranged roughly one half pitch length out-of-phase with respect to the strands 22. The strands 22 composed each from five core wires 23 and two strand winding wires 24. The cable winding strand 25 composed likewise from five core wires 26 and two strand winding wires 27. It can also be particularly advantageous for the reinforcement cable 21 according to FIG. 5 to be provided so that in the strands 22 and also in the cable winding strand 25 the core wires 23 respectively 26 and the strand winding wire 24 respectively 27, of helical shape, have the same slope, the same slope angle, and the same direction of rotation, and the core wires 23 and 26 are arranged connected nearly in-phase in a strand 22, respectively 25. Particularly favorable is an embodiment with which the strand winding wire 24 respectively 27 arrange roughly one half convolution length out-of-phase with regard to core wires 23, respectively 26.

EXAMPLE 1, Corrosion Test

Figure 6:
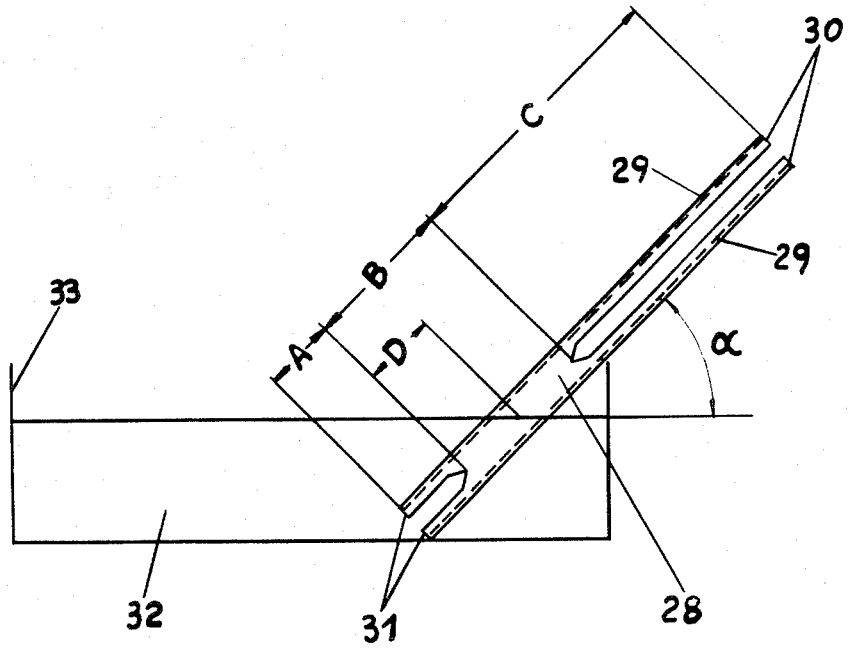
FIG. 6 schematically represents a test construction for corrosion testing for evaluating the reinforcement cable according to the present invention.

In order to verify the good characteristics of the reinforcement cable according to the present invention, corrosion tests according to a test construction unit schematically represented in FIG. 6 are performed, whereby the results of the reinforcement cables according to the present invention are compared with previously customary reinforcing cables.

For performance of the corrosion tests test body 28 is prepared, having two layers 29 each with fourteen cables per 32 mm such as to have been vulcanized into two different types rubber, both layers 29 having been vulcanized together inside a range B from 25.4 mm of the length of the test body. The range limits lie 12.5 mm (range A) from the one and 50 mm (range C) from the other front side removed, whereby the cable cross-section are visible at both front sides 30 and 31. The cable inside of cable layer 20 and both cable layers under one another lie in the longitudinal direction of the sample parallel to one another at constant intervals.

The prepared test body 28 is superficially immersed with the shorter, not vulcanized together side into a 20% NaCl solution 32 in a container below an angle of 45% to the bath surface in such manner that the immersion distance D of the vulcanized together area comes to 12.5 mm. Of the different cable types, several samples each are prepared, which either not at all (immersion 0 days) or several days have become immersed into the 20% NaCl solution.

Herewith two different, customary types of rubber are employed. After the course of the immersion period the cable layers of the test body are separated after chucking of both of the longer, not vulcanized together sides 30. The degree of rubber covering is evaluated inside of the previously vulcanized together range of both the separated test body halves 29, distinction being set according to immersed (range D) and not immersed range. 100% degree of covering indicates that neither cable nor cable part is visible at both test body halves 29.

Employed as cable are the following:

Cable I:

A reinforcement cable according to the present invention of four strands 2, with which five core wires 3 and two strand winding wires 4 of screw-like shape have the same slope angle, and the same rotary direction, and the core wires 3 of the cables 2 are disposed connected nearly in-phase, and a cable winding wire 5. The strand winding wires 4 are arranged approximately one half convolution out-of-phase from the core wires 3. The core wires 3 and the strand winding wires 4 have a diameter of 0.22 mm, whereas the cable winding wire 5 has a diameter of 0.15 mm. The winding of the strands is in cross-lay. The construction is typically indicated as $4\times(5+2\times0.22)+0.15$.

Cable II:

Construction as Cable I, however other wire numbers of construction $3\times(7+2\times0.22)+0.15$.

Cable III:

Construction as Cable I, however other wire numbers, as represented in FIG. 2, of construction $7\times(3+1\times0.22)+0.15$.

Cable IV:

Construction as Cable I, however other wire numbers, as represented in FIG. 3, of construction $7\times(2+2\times0.22)+0.15$.

Cable V:

Construction as Cable I, whereby instead of the cable winding wires a cable winding strand is wrapped around the cable. The reinforcement cable possesses three strands and a cable winding strand, the said strands possessing each five core wires and two strand winding wires of construction $$3+1\times(5+2\times0.22)$$

Cable VI:

A comparison cable doubly wrapped in cross-lay of construction $$7\times4\times0.22+0.15$$

Cable VII:

A comparison cable in simple cable lay of construction $$3+9+15\times0.22+0.15$$

The degree of rubber coating in % of the separated samples, in which according to the present invention respectively comparison reinforcement cables are embedded are set forth in Tables I and II in dependence upon the immersion period.

TABLE I

| Cables are embedded in rubber type 1. | Immersion Period (days) | | | |
|---|---|---|---|---|
| | 0 | 2.5 | 6 | 10 |
| Cable No. | | | | |
| I | 90 | 80 | 80 | 80 |
| II | 90 | 90 | 90 | 80 |
| Comparison Cable No. | | | | |
| VI | 90 | 10 | 0 | 0 |
| VII | 90 | 40 | 0 | 0 |

TABLE II

| Cables are embedded in rubber type 2. | Immersion Period (days) | | |
|---|---|---|---|
| | 0 | 5 | 10 |
| Cable No. | | | |
| I | 100 | 100 | 100 |
| III | 100 | 100 | 100 |
| IV | 100 | 100 | 100 |
| V | 100 | 100 | 100 |
| Comparison Cable | | | |
| VI | 100 | 100 | 60 |
| VII | 100 | 90 | 60 |

The test body with reinforcement cables according to the present invention proves thus to be more corrosion resistant than the test body with comparison cables.

EXAMPLE

Figure 7:
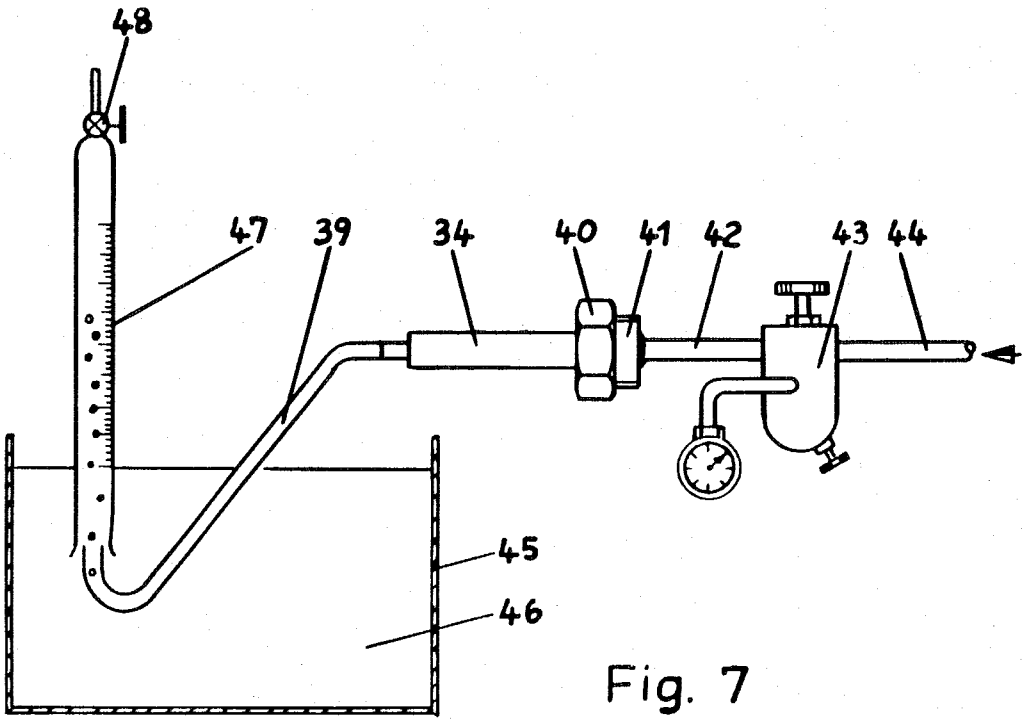
FIG. 7 schematically represents a test construction for evaluating determination of air permeability with embedded reinforcement cable according to the present invention.
Figure 8:
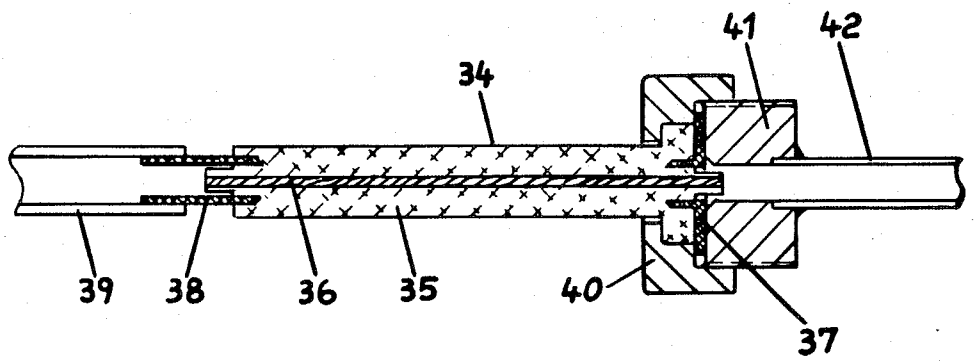
FIG. 8 is a longitudinal cross-section through the test unit as set forth in FIG. 7, as employed for determination of air permeability with embedded reinforcement cable.

In order to verify what the quality of embedding is of a reinforcement cable according to the present invention in rubber in comparison to previously customary reinforcement cables, the air permeability is determined according to FIG. 7, whereby a test body is employed according to FIG. 8.

A 7.5 cm long reinforcement cable 36 is for this purpose embedded into rubber 35, whereby the reinforcement cable 36 is visible at both front sides of the test body 34. Simultaneously are embedded into each test body 34 a packing disk 37 and a tube positioning piece 38 into the rubber 35.

The test body 34 is closed gas-tight with the collar ring 40 with a compressed air connecting piece 41. The compressed air connecting piece 41 is closed across a transition piece 42, a pressure reducing valve 43, and a compressed air conduit 44 closed into a (not represented) compressed air source.

At the tube fitting-in piece 38 a tube 39 is closed gas-tight, which with the open end is immersed into a tank 45 filled with water 46. The open end is curved from above and is located below the opening of a measuring cylinder 47 filled with water at the start of the test up to the zero mark, which likewise is immersed into the water bath 45, 46. By means of valve 48 the height of the water head is adjusted in measuring cylinder 47.

At the start of the air permeability determination a pressure of 1 bar is adjusted through the pressure reducing valve 43. Air can penetrate through the test body as a result of an incomplete embedding of the reinforcement cable 36 into the rubber mass 35, so that the produced air bubbles climb in the measuring cylinder 47. The accumulated amount of air per unit time in measuring cylinder 47 is measured.

As reinforcement cable were embedded into rubber type 2 the following:

The reinforcement cables I and V according to the present invention as set forth in Example 1.

Moreover, a further cable VIII according to the present invention is embedded, said cable constructed as Cable 1, however having two cable winding wires of the construction $$5\times(4+1\times0.22)+2\times0.22.$$

As comparison cable the Cables VI and VII from Example 1 are selected.

The results are set forth in Table III.

TABLE III

| The Cables are embedded in rubber type 2. | | | | | |
|---|---|---|---|---|---|
| Cable No. | I | V | VIII | VI | VII |
| Air Permeability ml/min | 0 | 0 | 0 | 265 | 565 |

The reinforcement cable according to the present invention are thus completely embedded into the rubber mass.

Figure 9:
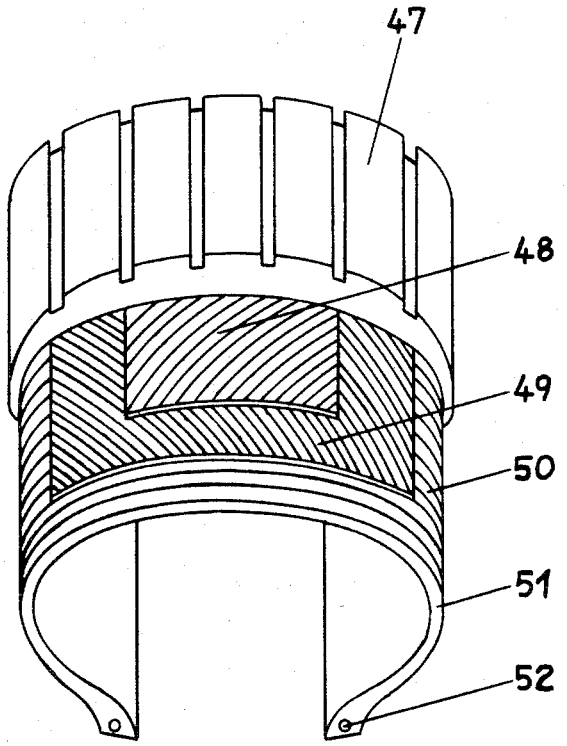
FIG. 9 schematically shows construction of a pneumatic tire into which are embedded reinforcement cable according to the present invention.

FIG. 9 shows schematically the construction of a tire in which are embedded reinforcement cable according to the present invention. Numeral 47 designates the operational surface of the tire, which is formed in this case as a radial tire. The operational surface 47 has embedded in it two layers 48 and 49 of reinforcing cable according to the present invention, which run at below a determined angle to the perimeter. This angle is selected according to the area of use of the tire. Into a carcass 51 are likewise embedded reinforcement cable 50 according to the present invention in the circumferential direction. In the rim band 52 there can similarly be embedded reinforcement cable according to the present invention.

It will be understood that each of the elements described above, or two or more together, may also find a useful application in other types of package reinforcements differing from the types described above.

While the invention has been illustrated and described as embodied in reinforcement cable for elastomeric conduits, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

We claim:

1. Reinforcement cable of metal wires for elastomeric conduits, comprising at least two cabled-together strands each having two or more wires, said strands including at least one outerlying strand composed of two or more core wires wrapped by at least one coil-shaped strand winding wire.

2. The reinforcement cable according to claim 1, wherein each outerlying strand is composed of two or more core wires wrapped by at least one coil-shaped strand winding wire.

3. The reinforcement cable according to claim 1, wherein each strand is composed of two or more core wires wrapped by at least one coil-shaped strand winding wire.

4. The reinforcement cable according to claim 1, wherein said strand winding wire comprises steel wire.

5. The reinforcement cable according to claim 1, wherein said strands collectively are enveloped by at least one cable winding wire and/or at least one cable winding strand, the said cable winding wire respectively strand is coil-shaped.

6. The reinforcement cable defined in claim 5, said strands numbering from three to seven.

7. The reinforcement cable defined in claim 6, said strands are enveloped by a maximum of four cable winding wires.

8. The reinforcement cable defined in claim 5, said strands are enveloped by a maximum of four cable winding wires.

9. The reinforcement cable defined in claim 6, said strands are enveloped by a maximum of four cable winding strands.

10. The reinforcement cable defined in claim 5, said strands are enveloped by a maximum of four cable winding strands.

11. The reinforcement cable defined in claim 5, said wire of said cabled-together strands and/or cable winding strands are of screw-shaped form of equal pitch, pitch angle and rotary direction, the said core wires of a strand are disposed bundled substantially in-phase.

12. The reinforcement cable defined in claim 5, wherein said core wires are arranged side-by-side and staggered whereby each of said core wires is in linear contact with at least one other said core wires so that defining a contact curve parallel to the said core wire.

13. The reinforcement cable defined in claim 5, said cabled together strands, said cable winding strands and/or said cable winding wire are of screw-shaped form and of equal pitch, pitch angle, and rotary direction, and said cabled-together strands are disposed bundled substantially in-phase.

14. The reinforcement cable defined in claim 1, wherein said strands each contain two to eight core wires.

15. The reinforcement cable defined in claim 1, wherein said strands each contain a maximum of four strand winding wires.

* * * * *